US006693242B1

(12) United States Patent
Bailey

(10) Patent No.: US 6,693,242 B1
(45) Date of Patent: Feb. 17, 2004

(54) ELECTRICAL INSULATOR ASSEMBLIES

(76) Inventor: John Edward Ferriman Bailey, 16 Springwood Drive, Stone, Staffs, ST15 8TU (GB)

( * ) Notice: Subject to any disclaimer, the term of this patent is extended or adjusted under 35 U.S.C. 154(b) by 0 days.

(21) Appl. No.: 10/009,089

(22) PCT Filed: May 12, 2000

(86) PCT No.: PCT/GB00/01825

§ 371 (c)(1),
(2), (4) Date: Dec. 14, 2001

(87) PCT Pub. No.: WO00/70627

PCT Pub. Date: Nov. 23, 2000

(30) Foreign Application Priority Data

May 13, 1999 (GB) ..... 9911024

(51) Int. Cl.[7] ..... H01B 17/00

(52) U.S. Cl. ..... 174/152 R; 174/138 F; 174/188

(58) Field of Search ..... 174/152 R, 138 F, 174/142, 152 G, 153 G, 186, 188

(56) References Cited

U.S. PATENT DOCUMENTS

| | | | | | |
|---|---|---|---|---|---|
| 2,845,477 | A | | 7/1958 | Kelley et al. | 174/163 |
| 4,031,311 | A | * | 6/1977 | Mazanek | 174/31 R |
| 4,330,270 | A | * | 5/1982 | Herrold | 432/259 |
| 4,343,560 | A | * | 8/1982 | Chalmers | 403/13 |
| 4,492,817 | A | * | 1/1985 | Selby | 174/152 R |
| 4,760,216 | A | | 7/1988 | Thiel et al. | 174/142 |

* cited by examiner

*Primary Examiner*—Dean A. Reichard
*Assistant Examiner*—Adolfo Nino
(74) *Attorney, Agent, or Firm*—Smith-Hill and Bedell

(57) ABSTRACT

An insulator assembly including an insulator with a lower part having a mounting bushing sealingly mounted thereon. The bushing being provided with a cylindrical body which is locatable over the groove, and can be shaped during manufacture to sealingly engage in the groove by a spinning technique.

42 Claims, 4 Drawing Sheets

ELECTRICAL INSULATOR ASSEMBLIES

This invention concerns electrical insulator assemblies, and particularly but not exclusively such assemblies usable with power transmission capacitors; and also a method of making such assemblies.

To date difficulties have often been encountered in satisfactorily mounting ceramic insulators on electrical equipment such as power transmission capacitors. Particular difficulties can be encountered with capacitors as these are generally filled with an inflammable liquid. This has particularly been the case due to the fact that precise dimensions cannot be obtained during the firing of ceramics and therefore subsequent precision grinding has sometimes been required. Alternatively, metal soldering has been used but this is generally not sufficiently fire resistant to be wholly satisfactory.

The term "spinning technique" when used in the specification is to be understood as describing a technique where a rotatable wheel or other projection is spun relative to an item, with the item and wheel/projection being urged against each other to shape the item.

According to the present invention there is provided an insulator assembly, the assembly comprising an insulator having a lower part for insulatingly mounting on a member of fixture, and an upper part connectable to an electrical source of the like, the lower part having a mounting bushing thereon sealingly extendible around the insulator, with the mounting bushing engaging in a circumferential groove in the insulator.

The mounting bushing is preferably shaped in situ on the insulator to engage in the groove. The mounting bushing may be shaped by a spinning technique.

A seal may be provided between a part of the mounting bushing and the insulator, and the seal may be made of rubber and desirably silicone rubber.

The insulator at the lower part is preferably non circular in cross-section to prevent relative rotation of the bushing thereon, and may be lobe shaped. A plurality of recesses may be provided to form the non-circular cross-section, and the recesses may be located circumferentially around the insulator, and may interconnect and be of variable depth.

The insulator is preferably made of a ceramic material and desirably porcelain.

The mounting bushing preferably provides a mounting flange. The mounting flange may extend radially or may extend at an in use downwards inclination. The mounting bushing may be made of metal and desirably stainless steel.

The mounting bushing may be in the form of part of the casing for a capacitor or other device.

The top part preferably comprises an electrically conducting connecting member in communication with the interior of the insulator, and a cap member engageable over a part of the connecting member and engageable with the insulator to mount the connecting member thereon.

Also according to the present invention there is provided an insulator assembly, the assembly comprising an insulator having a lower part for insulatingly mounting on a member of fixture, and an upper part connectable to an electrical source or the like, the top part comprising an electrically conducting connecting member in communication with the interior of the insulator, and a cap member engageable over a part of the connecting member and substantially non-rotatably engageable with the insulator to mount the connecting member thereon.

The cap member may be engageable with one or more formations on the insulator to prevent relative rotation. The formations may comprise one or more substantially longitudinal grooves in which one or more corresponding indentations in the cap member are locatable. The cap member may be mounted on the insulator by a spinning technique to cause the cap member to engage with the insulator, and the cap member may engage with a lip on the insulator.

The connecting member may extend through an opening in the cap member. A flange may be provided on the connecting member engageable against the insulator. The cap member may engage against the flange on the connecting member.

A seal may be provided between the connecting member and the insulator and the seal may be locatable between the connecting member and the insulator.

The seal may be made of rubber and desirably silicone rubber.

The connecting member may be in the form of a bolt. The connecting member and/or cap member may be made of brass.

The invention further provides an electrical insulator assembly for a power transmission capacitor, the assembly being according to any of the preceding fourteen paragraphs.

The invention also provides a method of making an electrical insulator assembly, the assembly being according to any of the preceding fifteen paragraphs.

The mounting bushing is preferably located on the insulator whilst the bushing has a substantially cylindrical body which locates over the groove in the insulator, and the cylindrical body is subsequently urged into the groove. The urging is preferably performed by a spinning technique.

The bushing may be glued onto the insulator, and desirably by an epoxy resin glue, prior to the urging being carried out.

When the bushing is part of a casing, the spinning technique is preferably carried out using a portable tool comprising one or more spinable members engageable against the bushing.

The cap member may be mounted on the insulator by a spinning technique, and the indentations in the cap member are preferably formed before the spinning technique.

Embodiments of the present invention will now be described by way of example only and with reference to the accompanying drawings, in which.

FIGS. 1 to 6 of the drawings show a first insulator assembly 10 suitable for mounting on a power transmission capacitor which would typically be full of oil. The assembly 10 comprises a porcelain insulator 12 of a generally conventional configuration including a plurality of radial projections 14 and grooves 16.

Figure 1:
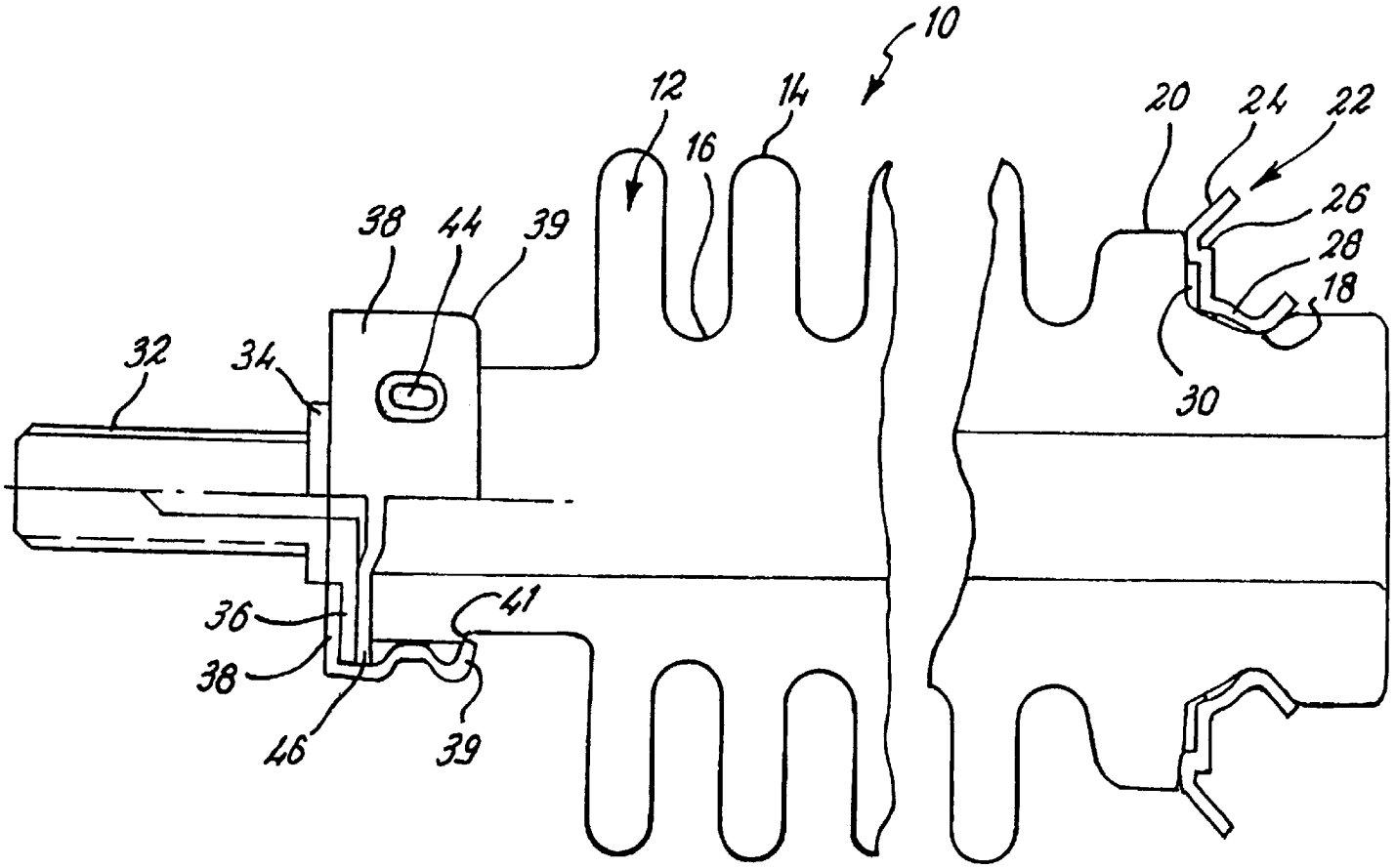
FIG. 1 is a diagrammatic side view of a first electrical insulator assembly according to the invention, with one end in part cross-section, the middle section omitted and the other end in full cross-section.

At the lower (right hand as shown in FIG. 1) end of the insulator 12 a circumferential slot 18 is provided which upwardly ends in a circumferential projection 20. Located within the slot 18 is a stainless steel bushing 22. The bushing 22 comprises an annular flange 24 which is inclined towards the lower end of the insulator 12, and which includes an inner step 26 leading to a generally cylindrical body 28 which locates and generally follows the shape of the slot 18. A silicone rubber seal 30 locates in the inner step 26. The inclination of the flange 24 advantageously spreads any later loads from the insulator 12.

The bushing 22 is mounted on the insulator 12 as follows. Initially the body 28 will have a substantially fully cylindrical shape, and as a result of this the bushing 22 can be pushed onto the end of the insulator 12 to abut the projection 20, with the seal 30 located in place, and held thereon under load. Using a spinning technique and by rotating the insulator 12, the body 28 is shaped to locate in the slot 18. During the spinning technique it is possible to ascertain when the body 28 has been fully pressed into the slot 18 by the change in resistive forces encountered. This technique provides for a strong and efficient mechanical seal. The use of the spinning technique allows slightly different shapes and sizes of slots 18 to be used as may be encountered with fired ceramic articles.

Figure 2:
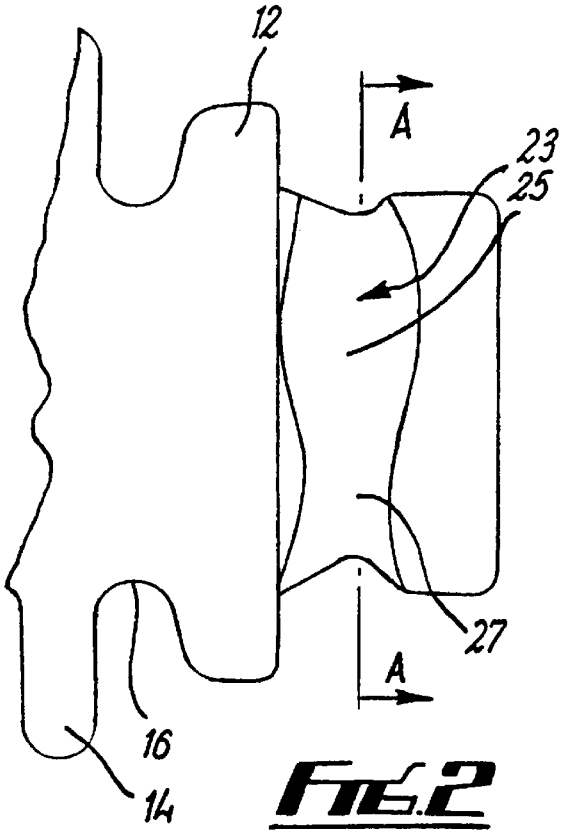
FIG. 2 is a diagrammatic side view of part of a component of the assembly of FIG. 1.
Figure 3:
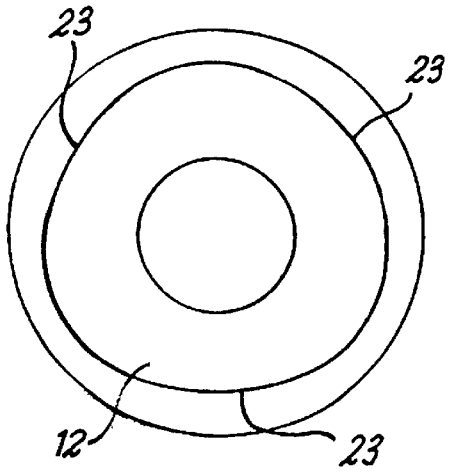
FIG. 3 is a cross-sectional view along the line A—A of FIG. 2.
Figure 4:
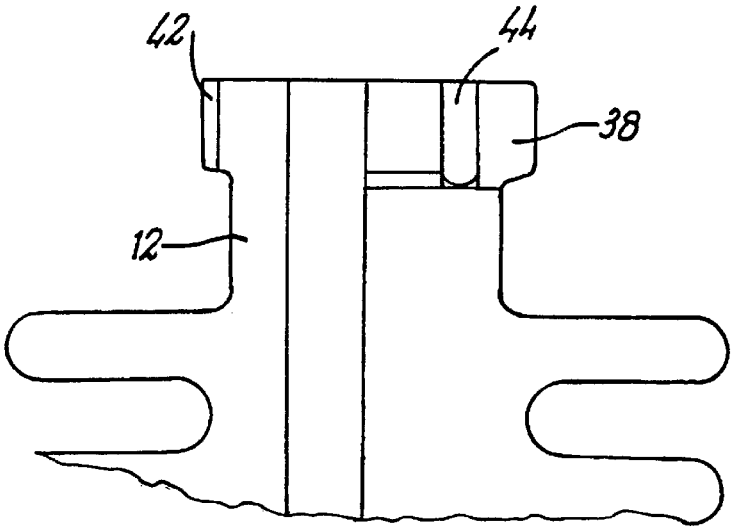
FIG. 4 is a diagrammatic view of part of the one end of the assembly of FIG. 1 with a component removed therefrom.
Figure 5:
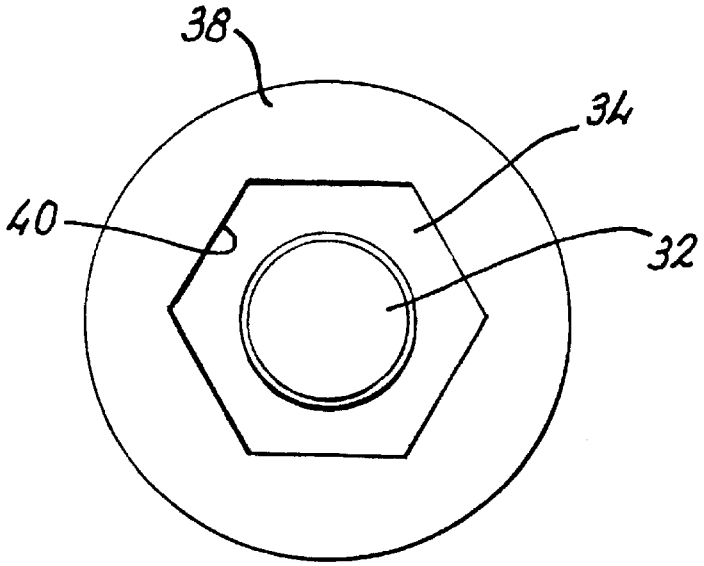
FIG. 5 is an end view of the assembly of FIG. 1.
Figure 6:
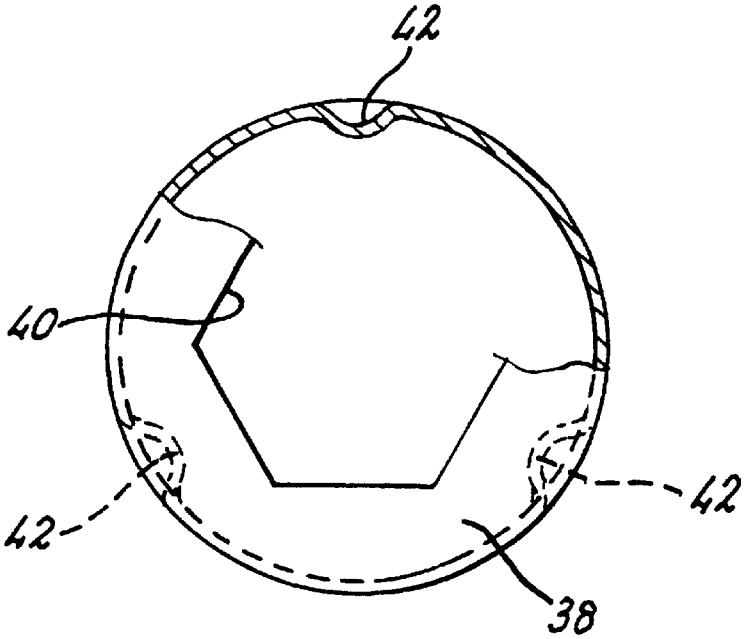
FIG. 6 is a diagrammatic view similar to FIG. 4 but with part of the insulator removed and part of the view in section.

As can be seen from FIGS. 2 and 3 the lower end of the insulator 12 and hence bushing 22 when pressed thereon has a slightly non-circular cross-section, and is in fact lobe shaped. The lobe shape is provided by three recesses 23 which interconnect circumferentially around the slot 18. The recesses 23 are substantially identical and comprise a mid-portion 25 of greatest extent which reduces gradually each way to end portions 27 of minimum extent, with end portions 27 of each recess 23 being interconnected.

This non-circular cross-section means that in practice the insulator 12 cannot be rotated within the bushing 22 pressed thereon, and when the bushing 22 is welded to or is part of a capacitor casing, no part of the bushing assembly 10 will rotate during the attachment or detachment of parts to the top of the bushing. Whilst the lobe shape is non-circular, it has a constant diameter and thus is quite suitable for use in an accurate spinning technique, with for instance a pair of diametrically opposed spaces spinning wheels.

At the upper end of the assembly 10 a brass connecting bolt 32 is provided. The bolt 32 has a hexagonal cross-section head 34 with a coaxial larger circular flange 36. The bolt 32 is held on the insulator 12 by a brass cap 38. The cap 38 has a closed end with a hexagonal opening 40 through which the head 34 extends. Three equispaced longitudinal slots 42 are provided on the upper end of the insulator 12, and corresponding indentations 44 on the inside of the cap 38 engage in the slots 42. The indentations 44 are preformed before location of the cap 38 on the insulator 12. An annular silicone rubber seal 46 is provided between the end of the insulator 12 and the bolt flange 36.

The upper end is formed by holding the cap 38 on the insulator 12 under load, and turning the bottom edge 39 inwardly using the spinning technique so as to engage with a lip 41 provided on the insulator 12 a short distance from the upper end thereof. The indentations 44 may be urged to engage in the slots 42.

There is thus described a strong seal with the slots and corresponding indentations preventing relative rotation between the components. The invention therefore provides an insulator assembly with a number of advantageous features. Strong fire proof seals are provided at both end of the assembly, with both arrangements preventing relative rotation between the respective components. Whilst strong seals are provided, the manufacturing technique is readily repeatable and thus consistent and inexpensive. The techniques also allow variations in the dimensions of the fired ceramic to be incorporated.

Figure 7:
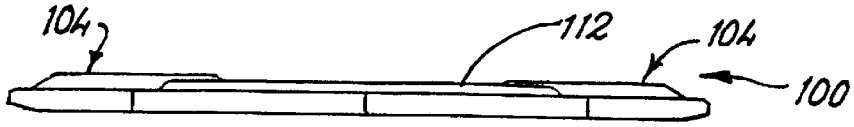
FIG. 7 is a side view of a part of a second electrical insulator assembly according to the invention.
Figure 8:
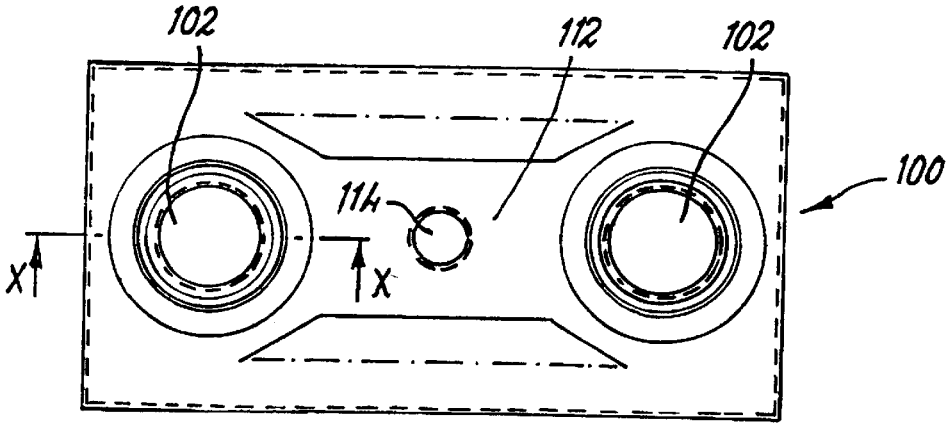
FIG. 8 is a diagrammatic plan view of the part of FIG. 7.
Figure 9:
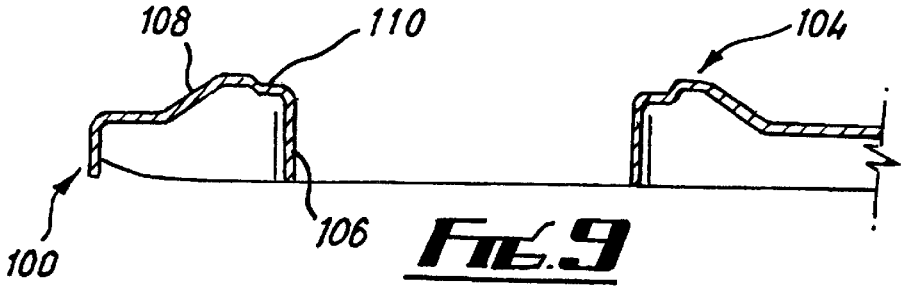
FIG. 9 is a cross-sectional view along the line X—X of FIG. 8.

FIGS. 7 to 9 show an embodiment of the invention in the form of a lid 100 for a capacitor casing. The lid 100 comprises two openings 102 each for receiving an insulator similar to that described above. Each opening 102 has a formation 104 provided therearound which is generally similar to the bushing described above. The formation 104 again comprises a cylindrical body 106 which can be shaped by spinning to engage in a slot around an insulator. A portable spinning tool would be provided to shape the cylindrical body 106. The cylindrical body 106 extends to an inclined flange 108 again with an inner step 110 to locate a seal (not shown) thereon. The lid 100 has a raised central area 112 with a central vent and filling hole 114.

Figure 10:
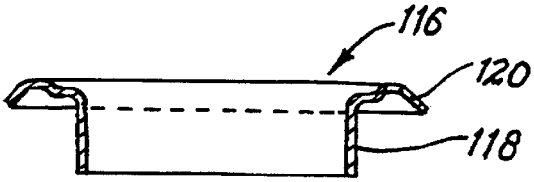
FIG. 10 is a diagrammatic cross-sectional view through a further component according to the invention.

In some instances and for instance with a casing lid which has openings on inclined surfaces, it may not be possible to mount a ceramic insulator on an integral bushing formation. In this instance a separate bushing formation 116 may be provided as illustrated in FIG. 10. This bushing 116 is similar to the arrangement shown on the lid 100 above, again with a cylindrical body 118 and an inclined flange 120. In use of the bushing 116, the flange 120 would be welded onto the lid in an appropriate position. The bushing 116 may be welded into position following mounting on a ceramic insulator.

Various other modifications may be made without departing from the scope of the invention. For example, the insulator may be a different shape or may have a different form. In particular the lower end may have a different shape and in some instances a circular shape may be acceptable. A different connection may be provided at the upper end. The bolt may have a different shaped head such as square.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An insulator assembly, the assembly comprising an insulator having a lower part for insulatingly mounting on a member of a fixture, and an upper part connectable to an electrical source, the lower part having a mounting bushing thereon sealingly extending around the insulator, with the mounting busing engaging in a circumferential groove in the insulator, characterized in that the mounting bushing provides a mounting flange at an upper end of the mounting bushing.

2. An insulator assembly according to claim 1, characterized in that the mounting bushing is shaped in situ on the insulator to engage in the groove.

3. An insulator assembly according to claim 2, characterized in that the mounting bushing is shaped by a spinning techinque.

4. An insulator assembly according to claim 1, characterized in that a seal is provide between a part of the mounting bushing and the insulator.

5. An insulator assembly according to claim 4, characterized in that the seal is made of rubber.

6. An insulator assembly according to claim 5, characterized in that the seal is made of silicone rubber.

7. An insulator assembly according to claim 1, characterized in that the groove has a base that is non circular in cross-section to prevent relative rotation of the bushing thereon.

8. An insulator assembly according to claim 7, characterized in that the base of the groove is lobe shaped in cross section.

9. An insulator assembly according to claim 7, characterized in that a plurality of recesses are provided to form the non-circular cross section.

10. An insulator assembly according to claim 9, characterized in that the recesses are located circumferentially around the insulator.

11. An insulator assembly according to claim 9, characterized in that the recesses interconnect.

12. An insulator assembly according to claim 9, characterized in that the recesses are of variable depth.

13. An insulator assembly according to claim 1, characterized in that the insulator is made of ceramic material.

14. An insulator assembly according to claim 13, characterized in that the insulator is made of porcelain.

15. An insulator assembly according to claim 1, characterized in that the mounting flange extends radially.

16. An insulator assembly according to claim 1, characterized in that the mounting flange extends at a downwards inclination.

17. An insulator assembly according to claim 1, characterized in that the mounting bushing is made of metal.

18. An insulator assembly according to claim 1, characterized in that the mounting bushing is made of stainless steel.

19. An insulator assembly according to claim 1, characterized in that the mounting bushing is part of the casing for a capacitor or other device.

20. An insulator assembly according to claim 1, characterized in that the upper part comprises an electrically conducting connecting member in communication with the interior of the insulator, and a cap member engageable over a part of the connecting member and engageable with the insulator to mount the connecting member thereon.

21. An insulator, the assembly comprising an insulator having a lower part for insulatingly mounting on a member of fixture, and an upper part connectable to an electrical source, the upper part comprising an electrically conducting connecting member in communication with the interior of the insulator, and a cap member engageable over a part of the connecting member and substantially non-rotatably engageable with the insulator to mount the connecting member thereon, characterized in that the cap member and the insulator have complementary formations that are mutally engageable positively to prevent relative rotation.

22. An insulator assembly according to claim 21, characterized in that the formations comprise one or more substantially longitudinal grooves in which one or more corresponding indentations in the cap member are locatable.

23. An insulator assembly according to claim 21, characterized in that the cap member in mounted on the insulator by a spinning technique to cause the cap member to engage with the insulator.

24. An insulator assembly according to claim 21, characterized in that the cap member engages with a lip on the insulator.

25. An insulator assembly according to claim 21, characterized in that the connecting member extends through an opening in the cap member.

26. An insulator assembly according to claim 21, characterized in that a flange in provided on the connecting member engageable against the insulator.

27. An insulator assembly according to claim 26, characterized in that the cap member engages against the flange on the connecting member.

28. An insulator assembly according to claim 21, characterized in that a seal is provided between the connecting member and the insulator.

29. An insulator assembly according to claim 28, characterized in that the seal is locatable between the connecting member and the insulator.

30. An insulator assembly according to claim 28, characterized in that the seal is made of rubber.

31. An insulator assembly according to claim 30, characterized in that the seal is made of silicon rubber.

32. An insulator assembly according to claim 21, characterized in that the connecting member is a bolt.

33. An insulator assembly according to claim 21, characterized in that the connecting member or cap member is made of brass.

34. A method of making an electrical insulator assembly comprising an insulator having a lower part for insulatingly mounting on a member of a fixture, and an upper part connectable to an electrical source, the lower part having a mounting bushing thereon sealingly extending around the insulator, with the mounting bushing engaging in a circumferential groove in the insulator, characterized in that the mounting bushing has a substantially cylindreical body and has a mounting flange at an end of the mounting bushing, said method comprising locating the mounting bushing on the insulator with the cylindrical body over the groove in the insulator and the mounting flange at an upper end of the mounting bushing, and subsequently urging the cylindrical body into the groove.

35. A method according to claim 34, characterized in that the urging is performed by a spinning technique.

36. A method according to claim 35, characterized in that when the bushing is part of a casing, the spinning technique is carried out using a portable tool comprising one or more spinable members engageable against the building.

37. A method according to claim 34, characterized in that the bushing is glued onto the insulator prior to the urging being carried out.

38. A method according to claim 37, characterized in that the bushing is glued onto the insulator by an epoxy resin glue.

39. A method according to claim 34, characterized in that the cap member is mounted on the insulator by a spinning techinque.

40. A method according to claim 39, characterized in that the indentions in the cap member are formed before the spinning techinque.

41. A method according to claim 34, comprising shaping the mounting bushing in situ on the insulator to engage in the groove.

42. An article of manufacture comprising a power transmission capacitor and an electrical insulator assembly, the electrical insulator assembly comprising an insulator having a lower part for insulatingly mounting on a member of a fixture, and an upper part connectable to an electrical source, the lower part having a mounting bushing thereon sealingly extending around the insulator, with the mounting bushing engaging in a circumferential groove in the insulator, characterized in that the mounting bushing provides a mounting flange at an upper end of the mounting bushing.

* * * * *